US006975736B2

(12) United States Patent
Hasegawa

(10) Patent No.: US 6,975,736 B2
(45) Date of Patent: Dec. 13, 2005

(54) MICROPHONE

(75) Inventor: Akinori Hasegawa, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/487,080

(22) PCT Filed: Jun. 30, 2003

(86) PCT No.: PCT/JP03/08271

§ 371 (c)(1),
(2), (4) Date: Feb. 18, 2004

(87) PCT Pub. No.: WO2004/010732

PCT Pub. Date: Jan. 29, 2004

(65) Prior Publication Data

US 2004/0240699 A1 Dec. 2, 2004

(30) Foreign Application Priority Data

Jul. 19, 2002 (JP) ..... 2002-210749

(51) Int. Cl.[7] ..... H04R 25/00
(52) U.S. Cl. ..... 381/174; 381/355; 381/369
(58) Field of Search ..... 381/355–358, 381/357, 360, 174, 191, 369, 173, 190, 113, 381/116; 367/140, 170, 181; 29/25.41, 25.42, 29/594, 609.1

(56) References Cited

U.S. PATENT DOCUMENTS 4,281,222 A * 7/1981 Nakagawa et al. ..... 381/357

FOREIGN PATENT DOCUMENTS

| | | | |
|---|---|---|---|
| JP | 61-025399 | A | 2/1986 |
| JP | 06-292288 | A | 10/1994 |
| JP | 09-168198 | A | 6/1997 |
| JP | 2002-135880 | A | 5/2002 |

OTHER PUBLICATIONS

International Search Report for application No. PCT/JP03/08271 dated Sep. 30, 2003.

* cited by examiner

*Primary Examiner*—Huyen Le
(74) *Attorney, Agent, or Firm*—RatnerPrestia

(57) ABSTRACT

A microphone includes a diaphragm for receiving a sound pressure, a back plate disposed parallel to the diaphragm, a support for holding the diaphragm and the back plate with a fixed gap in between, and a mechanoelectric transducer coupled to the back plate. These items are housed in a case, and a hole is provided on the side of the case that is not directly opposite the diaphragm. By making the volume of the confined space small by using the diaphragm as the boundary surface, mechanical resistance can be increased, and sensitivity to an excessive sound pressure can be reduced thus enabling suppression of generation of distortion.

7 Claims, 3 Drawing Sheets

MICROPHONE

This application is a U.S. National Phase Application of PCT International Application PCT/JP03/08271.

TECHNICAL FIELD

The present invention relates to microphones for use in various electronic devices such as audiovisual equipment and car audio equipment.

BACKGROUND ART

FIG. 3 is a cross-sectional view for illustrating conventional microphone structure.

Conventional microphones comprised case 3, diaphragm 1 that vibrates on receiving a sound pressure, back plate 2 disposed in parallel to diaphragm 1 with a fixed gap in between and having through-hole 2*a,* support 5 for holding diaphragm 1 and the periphery of back plate 2 with a fixed gap between them, mechanoelectric transducer 4 coupled to back plate 2, output terminal 6 for taking out an electric signal from mechanoelectric transducer 4 from inside case 3 to the outside, and hole 3*a* provided on the side of case 3 that directly faces diaphragm 1.

A description of the operation of the microphone will now be given below with reference to FIG. 3.

When pressure of a sound is transmitted to diaphragm 1 through hole 3*a,* the sound pressure is applied to the entire interior of the case that is not directly facing diaphragm 1 through two or more through holes 2*a* provided on back plate 2. As a result, diaphragm 1 vibrates and the fixed gap between diaphragm 1 and back plate 2 that is held parallel to diaphragm 1 changes thus causing a change in the electrostatic capacitance. The change in the capacitance is converted into an electric signal by mechanoelectric transducer 4 and put out to output terminal 6.

When pressure of an excessive sound is applied to diaphragm 1 of conventional microphones, diaphragm 1 that is deformed comes into contact with back plate 2. Consequently, conventional microphones suffered a problem in that the diaphragm became unable to vibrate at above a certain sound pressure level and distortion was caused.

DISCLOUSRE OF INVENTION

The present invention addresses the above described problems of conventional microphones and aims at providing a microphone which does not produce distortion even in the event an excessive sound pressure is applied.

In order to achieve the above object, the microphone of the present invention comprises:

a diaphragm having a first face and a second face;

a back plate that faces the second face of the diaphragm with a fixed gap in between;

a support for holding the diaphragm and the back plate;

a mechanoelectric transducer coupled to the back plate; and a case for housing the diaphragm, the back plate, the support and the mechanoelectric transducer; where the diaphragm divides the interior space of the case into a first space that is in contact with the first face and a second space that is in contact with the second face;

the back plate is housed in the second space inside the case; and the case has a through hole on the part that is in contact with the second space.

BEST MODE FOR CARRYING OUT THE INVENTION

A description of the present invention will be given below in terms of a preferred embodiment.

Figure 1:
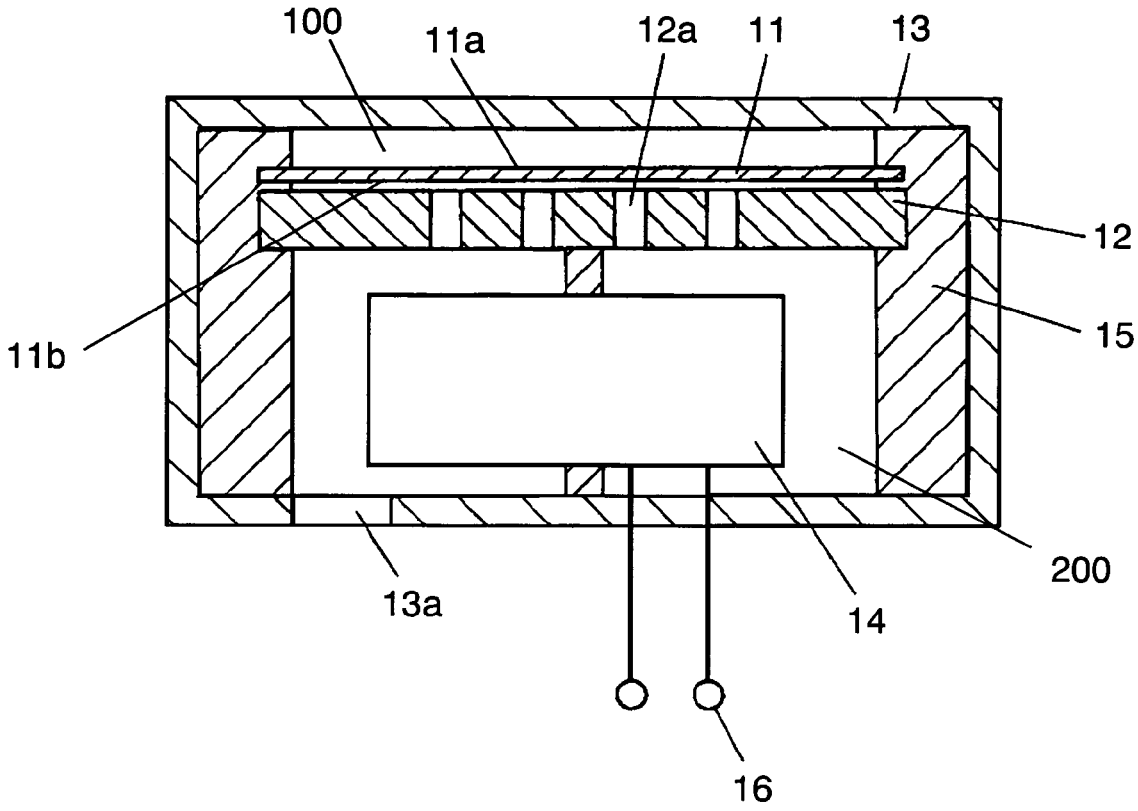
FIG. 1 is a cross-sectional view for illustrating the structure of a microphone in a preferred embodiment of the present invention.

Preferred Embodiment 1:

Referring to FIG. 1, a description of Preferred Embodiment I will be given.

As illustrated in FIG. 1, the microphone as described in this preferred embodiment comprises case 13, diaphragm 11 having first face 11*a* and second face 11*b* that vibrates upon receiving a sound pressure, back plate 12 disposed in parallel to diaphragm 11 and having through hole 12*a,* support 15 for holding diaphragm 11 and the periphery of back plate 12 with a fixed gap in between, mechanoelectric transducer 14 formed of a semiconductor device and coupled to back plate 12, output terminal 16 for taking out an electric signal of mechanoelectric transducer 14 from inside case 13 to the outside, and is provided with hole 13*a* on the side of case 13 that does not directly face diaphragm 11.

A description of the operation of a microphone of Preferred Embodiment 1 will be given below.

When a sound pressure is transmitted through hole 13*a* to second space 200 that is not directly facing diaphragm 11, the sound pressure is applied to diaphragm 11 through two or more through holes 12*a* provided on back plate 12. As a result, diaphragm 11 vibrates, the fixed gap between diaphragm 11 and back plate 12 held in parallel to diaphragm 11 changes, and a change in the capacitance is caused. And the change in the capacitance is converted into an electric signal by mechanoelectric transducer 14 that consists of a semiconductor device, and is put out to output terminal 16 which is connected to mechanoelectric transducer 14.

Generally, the sensitivity of a microphone to a sound pressure is inversely proportional to the mechanical resistance of diaphragm 11. As the air sealed in a confinable space with diaphragm 11 as the boundary surface acts as mechanical resistance of diaphragm 11, when the volume of the confined space is small, the mechanical resistance is large and the sensitivity is low. When the confined space is large, the mechanical resistance is small and the sensitivity is large.

Figure 3:
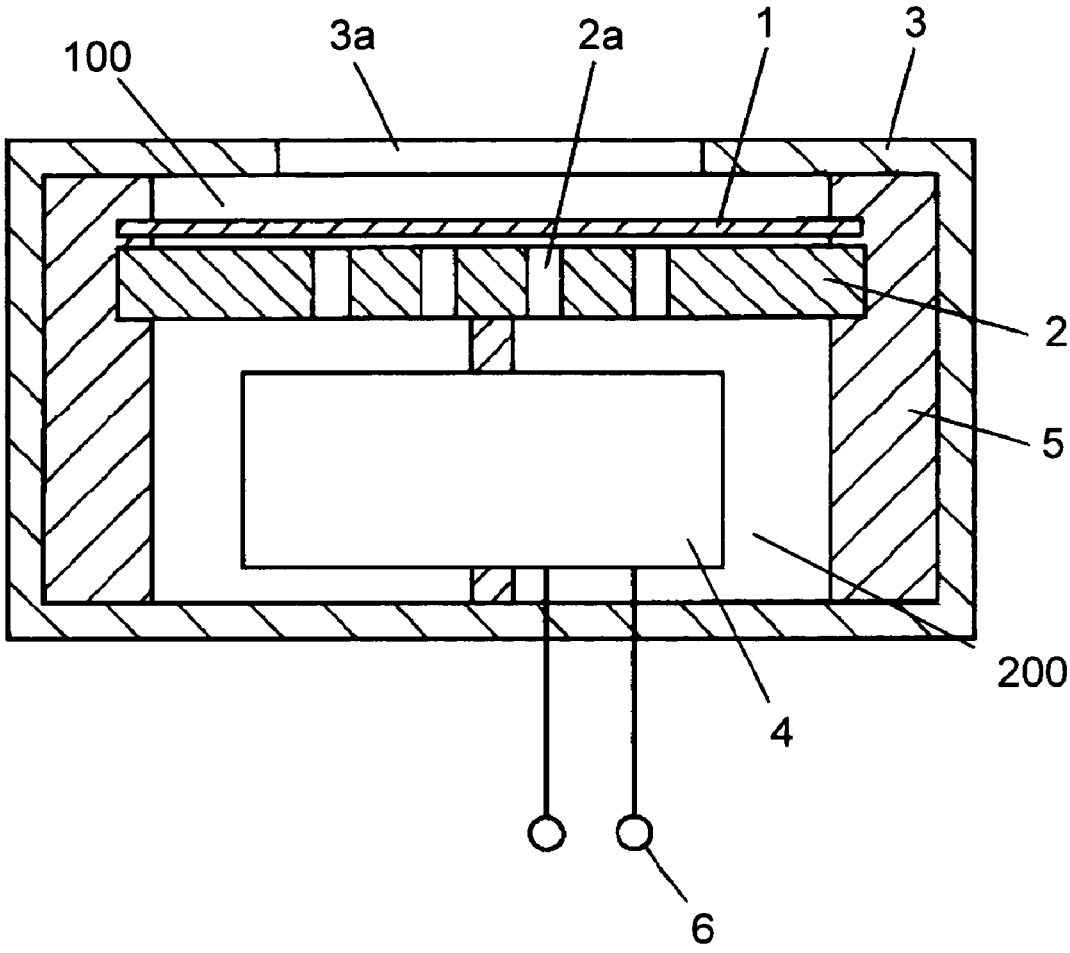
FIG. 3 PRIOR ART
FIG. 3 is a cross-sectional view for illustrating the structure of a conventional microphone.

In the case of Preferred Embodiment 1, first space 100 in which first face 11*a* of diaphragm 11 directly faces case 13 becomes a confined space. On the other hand, with the conventional microphone as shown in FIG. 3, second space 200 is a confined space. Accordingly, even when the volume of case 13 is the same, the microphone in Preferred Embodiment 1 has a smaller confined space than the confined space of the conventional microphone.

As has been described above, since the microphone of Preferred Embodiment 1 can be constructed with scarcely any change in the conventional microphone shape, and the volume of the confined space can be reduced by using the diaphragm as the boundary surface, the mechanical resistance becomes large, sensitivity to an excessive sound pressure is reduced, and the generation of distortion can be suppressed.

Figure 2:
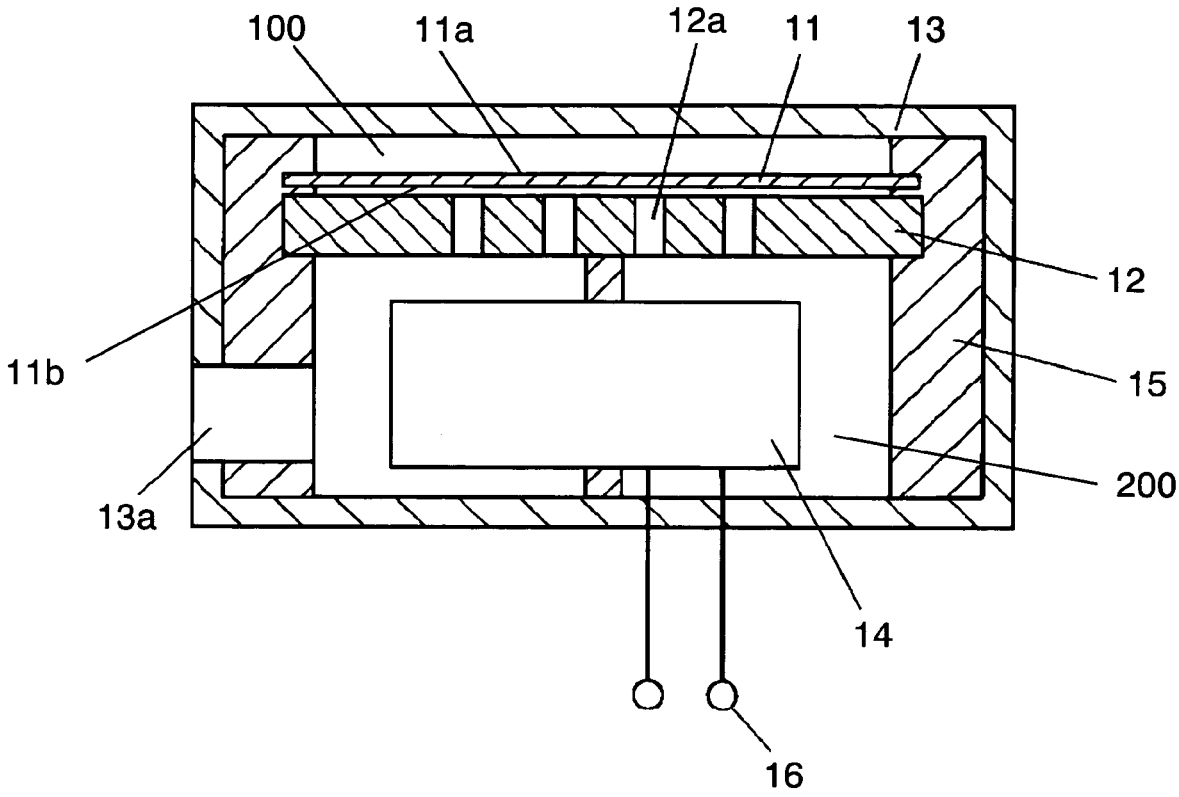
FIG. 2 is a cross-sectional view for illustrating the structure of a microphone in other preferred embodiment of the present invention.

Preferred Embodiment 2:

Referring to FIG. 2, a description of a microphone in Preferred Embodiment 2 will be given.

The microphone of Preferred Embodiment 2 has the same structural elements as those of the microphone in Preferred Embodiment 1, and hole 13*a* is provided on the side of case 13 that intersects diaphragm 11 at right angles having first face 11*a* and second face 11*b*.

A description on the operation of the microphone in Preferred Embodiment 2 will be given below.

When a sound pressure is transmitted through hole 13*a* to second space 200 that does not directly face diaphragm 11, the sound pressure is applied to diaphragm 11 through two or more through holes 12*a* provided on back plate 12. As a result, diaphragm 11 vibrates, the fixed gap between diaphragm 11 and back plate 12 that is held in parallel to diaphragm 11 changes, and a change in capacitance is caused. And the change in the capacitance is converted into an electric signal by mechanoelectric transducer 14 constituted by a semiconductor device, and is put out to output terminal 16 which is connected to mechanoelectric transducer 14.

By adopting a structure as described above, a microphone can be constructed with scarcely any change in the conventional microphone structure. Also, as the mechanical resistance can be increased by reducing the volume of the confined space by using the diaphragm as the boundary surface, sensitivity to an excessive sound pressure is reduced, and generation of distortion can be controlled. Also, when mounting on a printed circuit board, as hole 13*a* is provided on the side, sensitivity change due to closing of hole 13*a* by the neighboring printed circuit board can be prevented.

INDUSTRIAL APPLICABILITY

As has been described above, the present invention is a microphone in which a diaphragm for receiving a sound pressure, a support for holding the diaphragm and a back plate disposed parallel to it with a fixed gap in between, and a mechanoelectric transducer coupled to the back plate are housed in a case, and a hole is provided on the side of the case that is not directly facing the diaphragm. As the microphone can be configured with scarcely any modification from original microphone shape and the volume of the confined space can be reduced by using the diaphragm as the boundary surface, the mechanical resistance can be increased, sensitivity to an excessive sound pressure can be reduced and generation of distortion can be controlled.

What is claimed is:

1. A microphone comprising:

a diaphragm having a first face and a second face;

a back plate that opposes the second face of the diaphragm spaced apart from the second face of the diaphragm with a fixed gap in between;

a support for holding the diaphragm and the back plate;

a mechanoelectric transducer coupled with the back plate; and a case for housing the diaphragm, the back plate, the support and the mechanoelectric transducer, wherein the diaphragm divides interior space of the case into a first space that is in contact with the first face and a second space that is in contact with the second face; and wherein the back plate is housed in the second space inside the case and the case has a through hole on the part that is in contact with the second space, said case sealed on a side of said case where said first space is located.

2. The microphone of claim 1 wherein the back plate has a through hole.

3. The microphone of claim 2 wherein the volume of the first space is smaller than the volume of the second space and the mechanoelectric transducer is housed in the second space.

4. The microphone of claim 1 wherein the mechanoelectric transducer is housed in the second space.

5. The microphone of claim 1 wherein the volume of the first space is smaller than the volume of the second space.

6. The microphone of claim 1:

wherein the support is provided on side faces inside the case;

wherein the case has the side faces, an upper face and a bottom face wherein the upper face and the bottom face are parallel to the diaphragm;

wherein the second space is enclosed by the side faces and the bottom face of the case and the second face of the diaphragm; and wherein the hole is formed on at least one of the side faces and the bottom face of the case that enclose the second space.

7. The microphone of claim 6 wherein the volume of the first space is smaller than the volume of the second space.

* * * * *